US005379946A

United States Patent [19]

Emery

[11] Patent Number: 5,379,946

[45] Date of Patent: Jan. 10, 1995

[54] STAND ALONE FOLDING BOTTLE PACKS

[76] Inventor: Roy W. Emery, 1 Donino Ct., Toronto, Ontario, Canada, M4N 2H6

[21] Appl. No.: 246,799

[22] Filed: May 20, 1994

[51] Int. Cl.[6] ..... B65D 25/04

[52] U.S. Cl. ..... 229/120.38; 206/561

[58] Field of Search ..... 229/120.06, 120.07, 229/120.29, 120.38; 206/561

[56] References Cited

U.S. PATENT DOCUMENTS

| | | | |
|---|---|---|---|
| Re. 29,248 | 6/1977 | Congleton | 220/23.4 X |
| 1,121,232 | 12/1914 | Davis . | |
| 2,702,648 | 2/1955 | Fisher . | |
| 2,990,945 | 7/1961 | Smith . | |
| 3,400,873 | 9/1968 | Bessett . | |
| 3,552,595 | 1/1971 | Gerner et al. . | |
| 3,647,105 | 3/1972 | Keeslar | 220/23.4 |
| 3,807,622 | 4/1974 | Belcher et al. . | |
| 3,834,609 | 9/1974 | Congleton | 229/120.07 |
| 4,884,740 | 12/1989 | Ross | 229/120.29 X |

*Primary Examiner*—William I. Price

*Attorney, Agent, or Firm*—Marshall, O'Toole, Gerstein, Murray & Borun

[57] ABSTRACT

A stand alone folding bottle pack to separate and protect from injurious contact with each other the individual bottles in at least two rows of bottles standing vertically in a container, said bottle pack being manufactured in a partially or fully unfolded condition to facilitate moulding and unmoulding and stacking for packaging prior to use, and then optionally locked in the folded stand alone condition, for manual or mechanical insertion into said container, appropriately located and standing erect, ready to receive said bottles, which may then also be inserted either manually or mechanically.

8 Claims, 9 Drawing Sheets

STAND ALONE FOLDING BOTTLE PACKS

FIELD OF THE INVENTION

This invention relates generally to bottle packs which separate bottles placed vertically in a container, and guard them from injurious contact with each other.

BRIEF DESCRIPTION OF THE PRIOR ART

There are a great variety of methods and products in common use for holding separate from each other bottles placed vertically in a container, some of which hold the bottles at their tops and bottoms, while others, such as the bottle packs, provide a separating panel or panels inserted between the rows, said panels having ribs or other projections or configurations appropriately spaced to separate the individual bottles in a row from each other. Some bottle packs, or cushion separators as they are sometimes called, present a single face to one row of bottles, while others may be folded, to present two faces, for insertion between two rows of bottles already placed in the container.

BRIEF SUMMARY OF THE INVENTION

It is the object of this invention to create a new and unique type of bottle packs which may be inserted, in a first stage, either manually or mechanically, into a container in advance of placing the bottles there, with the separating panels of said bottle packs then standing vertically upright in folded pairs, and properly located for inserting said bottles in a second stage, also either manually or mechanically, into their predetermined positions, standing vertically and separated from each other by said folding pairs of vertical panels of said bottle packs. These new types of bottle packs, or multiple bottle packs, have each of said pairs of vertical panels serving as a protective barrier between two rows of bottles, each panel of said vertical pairs of panels having one or more outwardly projecting ribs or other configurations, whereby to separate the individual bottles in each row of bottles. Bottom panels are each connected at an edge or edges to the bottom edge of at least one of said vertical panels in such manner as to maintain said vertical panels in a vertical position when said bottom panels are seated horizontally on the bottom wall of said container, the perimeter dimensions of said bottom panels being such as to fit closely within the sidewalls of said container, whereby to maintain said vertical panels in their predetermined locations within said container.

Said bottom panels, reinforced by their connection to said vertical panels, may also serve as a partial support for the bottles, whereby to enhance the carrying capacity of said bottom wall of said container.

BRIEF DESCRIPTION OF THE DRAWINGS

In the drawings, which illustrate some preferred embodiments of the invention.

DETAILED DESCRIPTION OF PREFERRED EMBODIMENTS

Figure 1:
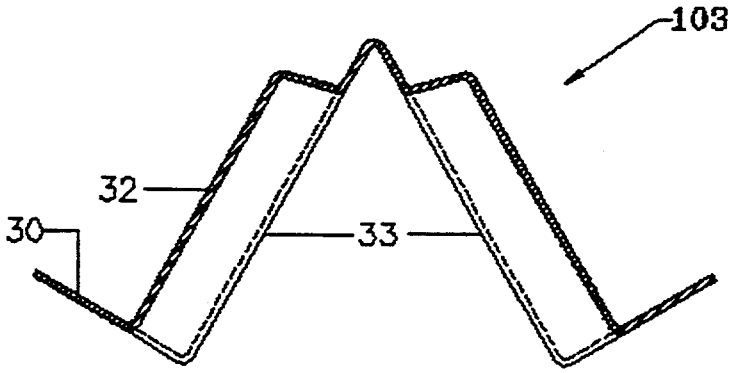
FIG. 1 is a cross-section at line AA of FIG. 2 through a stand up folding bottle pack 103, shown in the partially folded condition in which it can be made in a pulp moulding line equipped with a hot press dry finishing system.
Figure 2:
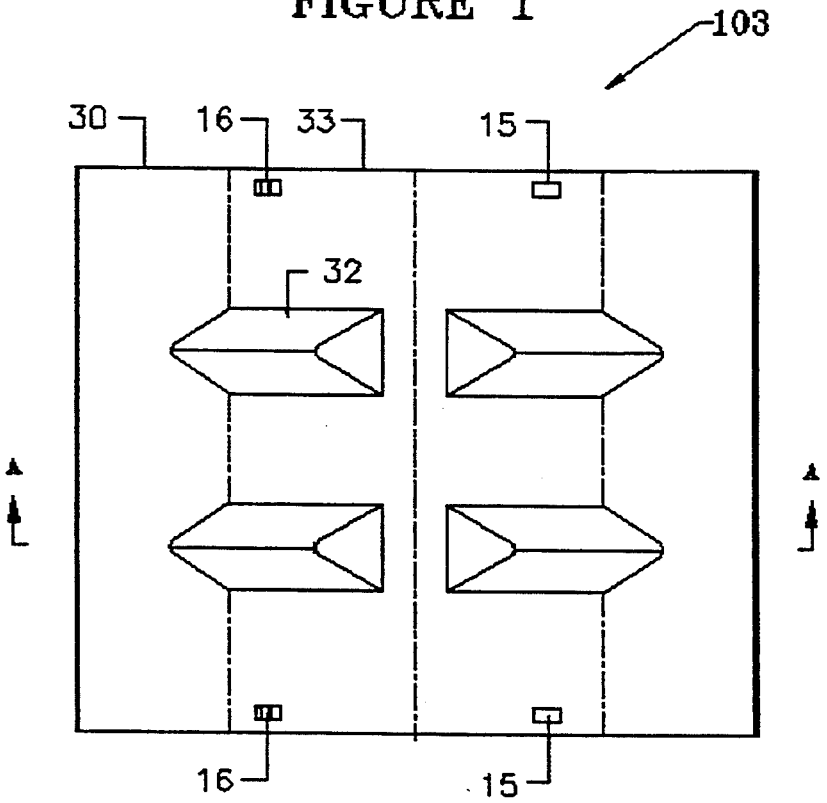
FIG. 2 is a plan view of said bottle pack 103 in said partially folded condition.

In the drawings, FIG. 1 shows a cross-section, taken at line AA in FIG. 2, of a stand alone folding bottle pack 103, shown in a partly folded condition as manufactured, to separate from each other the individual bottles 17 in two rows of bottles with three bottles in each row, said bottle pack 103 being comprised of:

two vertical panels 33 hingedly connected to each other at their top edges, each of said vertical panels 33 having two outwardly directed ribs 32 stretching in parallel from the bottom edge of said vertical panel 103 towards the top edge of said panel;

two horizontal bottom panels 30, each rigidly connected at an edge to the bottom edge of one of said vertical panels 33 at an angle of 90°, and to the bottom edges of the related two ribs 32, the maintenance of the 90° angle being reinforced by the connection of said two ribs 32 to said bottom panel 30.

Figure 16:
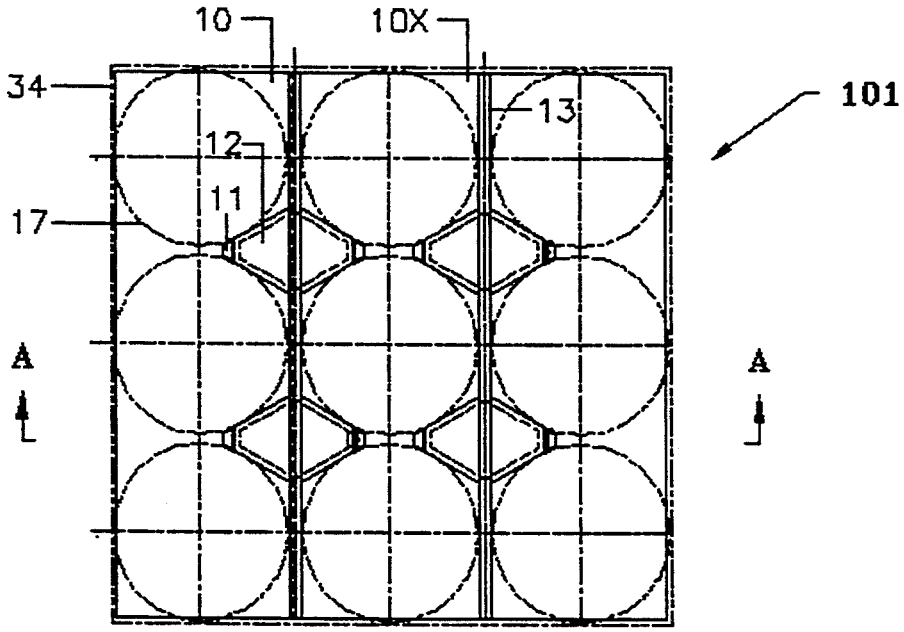
FIG. 16 is a plan view of said bottle pack 101, shown in the completely folded stand up condition, with the three rows of three bottles each in place on said bottom panels of said bottle pack 101.
Figure 17:
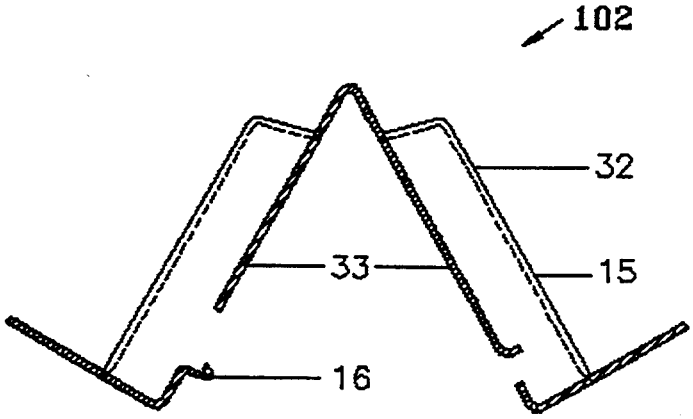
FIG. 17 is a cross-section at line BB of FIG. 2 through the bottle pack 103, showing a locking device in place.

FIG. 2 shows a plan of said bottle pack 103 in the partly folded condition of FIG. 1, showing the location of the two elements 15 and 16 of the optional locking device of FIG. 16, located at each end of said vertical panels 33, and the location of said ribs 32, spaced apart from each other and from each end of said bottle pack 103 at predetermined intervals and connected to said bottom panels 30.

Figure 3:
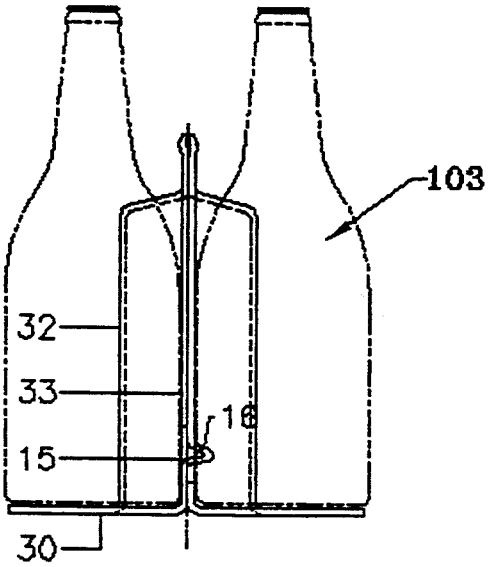
FIG. 3 is an end view of said bottle pack 103 in the completely folded stand up condition with two rows of bottles in place on the bottom panels of said bottle pack 103.

FIG. 3 is an end view of said bottle pack 103 of FIG. 1 with said vertical panels 33 folded together in contact with each other to form a protective barrier between the two rows of bottles 17, locked together with the locking elements 15 and 16, and with the bottom panels 33 in a horizontal position whereby to support the two rows of bottles 17 and to maintain said vertical panels 33 in the required stand up vertical position.

Figure 4:
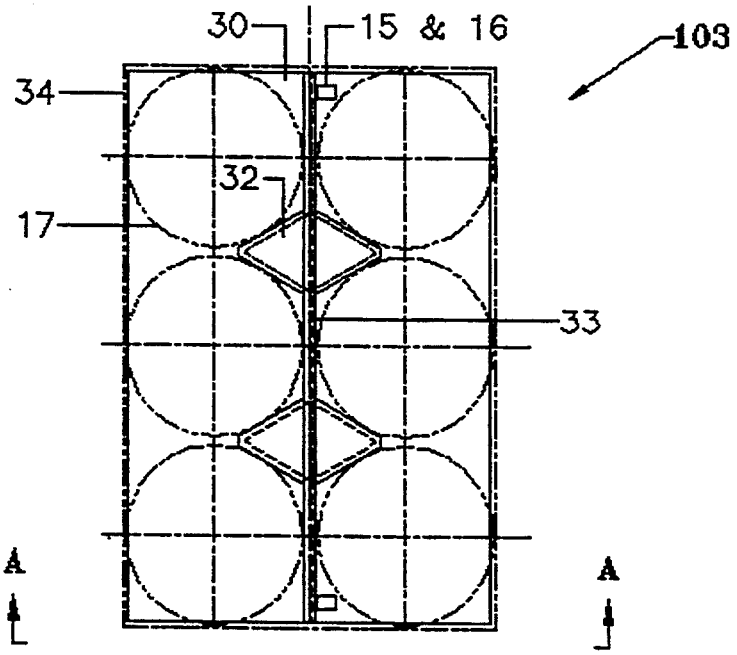
FIG. 4 is a plan view of said bottle pack 103, in said completely folded stand up condition with two rows of three bottles each in place on the bottom panels of said bottle pack 103.
Figure 18:
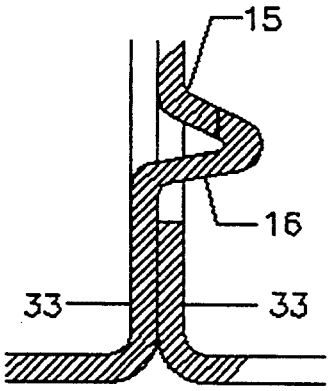
FIG. 18 is an enlarged detail of the locking device shown in FIG. 17.

FIG. 4 is a plan view of said bottle pack 103 with the two rows of bottles 17 in place on said bottom panels 30 and spaced apart by said vertical panels 33 with the bottles 17 in each row spaced apart from each other by said ribs 32, with said lock elements 15 and 16 of the locking device of FIG. 18, both projecting from one side of said pair of panels 33, and the perimeter dimensions of the two bottom panels together being of appropriate size to fit within the side walls 34 of the container in which they are to be placed.

Figure 5:
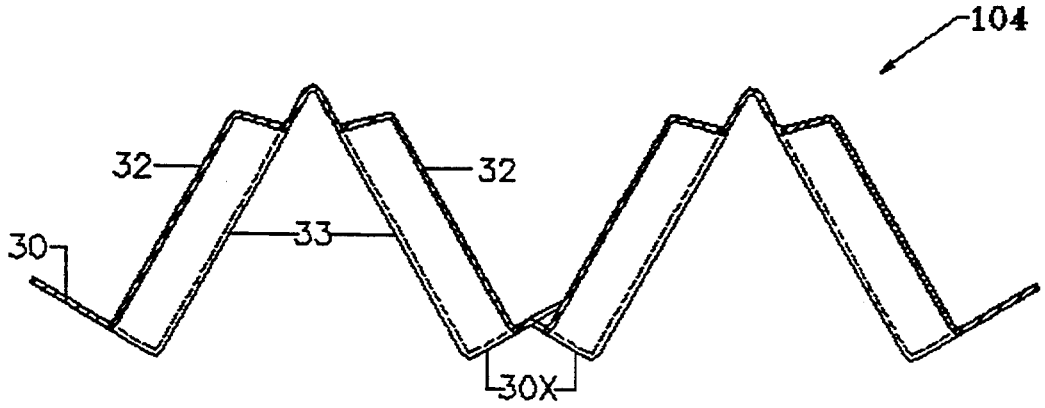
FIG. 5 is a cross-section at line AA of FIG. 6 through a multiple folding bottle pack type 104 shown in the partially folded condition in which it can be formed.
Figure 6:
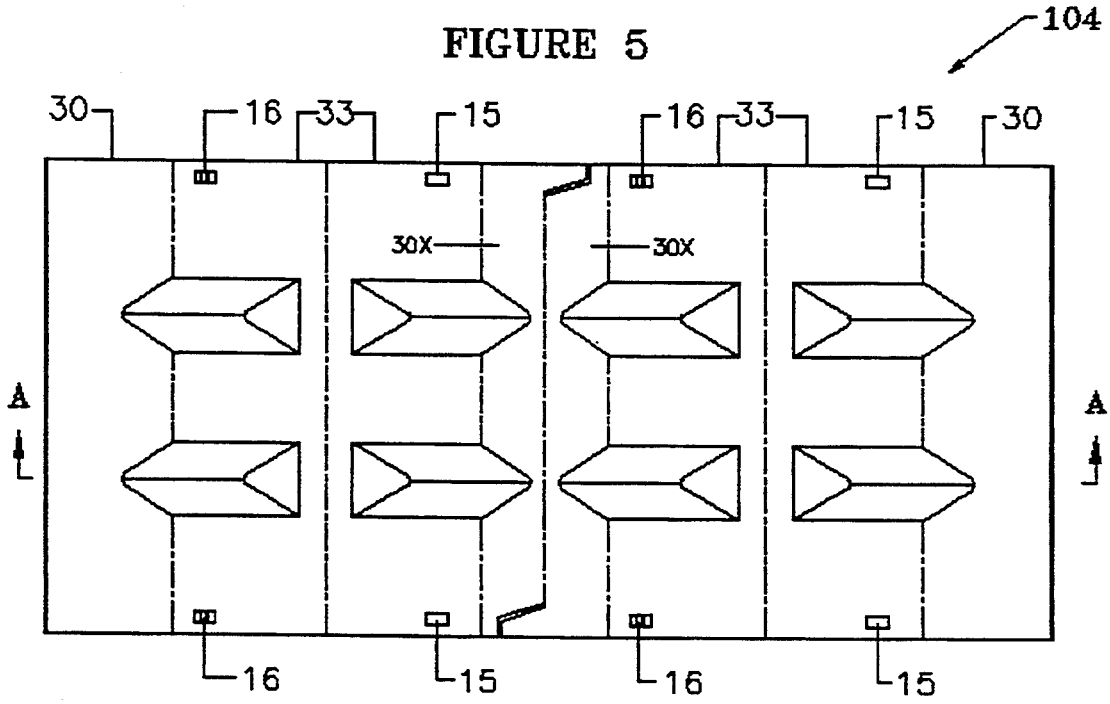
FIG. 6 is a plan view of said multiple folding bottle pack in said partially folded condition.

FIG. 5 is a cross-section taken at line AA of FIG. 6 of a multiple stand alone bottle pack 104, shown in the partly folded condition as manufactured, to separate from each other the individual bottles 17 in three rows of said bottles with three bottles in each row, said bottle pack 104 being comprised of:

four vertical panels 33 hingedly connected to each other in pairs at their respective top edges, each of said vertical panels 33 having two outwardly directed ribs 32 stretching vertically in parallel from the bottom edge of said vertical panel 33 towards the top edge of said panel;

two horizontal bottom panels 30, the first of said bottom panels 30 being rigidly connected at an edge to the bottom edge of the vertical panel 33 facing the first row of bottles 17 in the pack to form an angle of 90° between said first bottom panel 30 and said vertical panel 33, and the second of said bottom panels 30 being rigidly connected at an edge to the bottom edge of the vertical panel 33 facing the third row of said bottles 17 in the pack to form an angle of 90° between said second bottle pack 30 and said vertical panel 33;

two horizontal bottom panels **30*x* hingedly connected to each other at their respective first edges, and each of said bottom panels 30*x* being rigidly connected to the bottom edge of one of said vertical panels 33 facing said intermediate row of bottles 17**;

each of said bottom panels 30 and **30*x* being rigidly connected to the bottom edges of the ribs 32 of the vertical panels 33** to which they are also connected.

FIG. 6 is a plan view of the bottle pack 104 of FIG. 5 showing the four of said vertical panels 33 connected together in pairs at their top edges, the two bottom panels **30*x* connected together in a pair at their first edges, and the two bottom panels 30, two bottom panels 30*x* and the four vertical panels 33 being connected together in a continuously connected series, each of said bottom panels 30 and 30*x* being rigidly connected also to each of the two ribs 32 on the particular vertical panel 33 to which they are also connected; the elements 15 and 16** of the four locking devices being shown in their respective locations at each end of each vertical panel.

Figure 7:
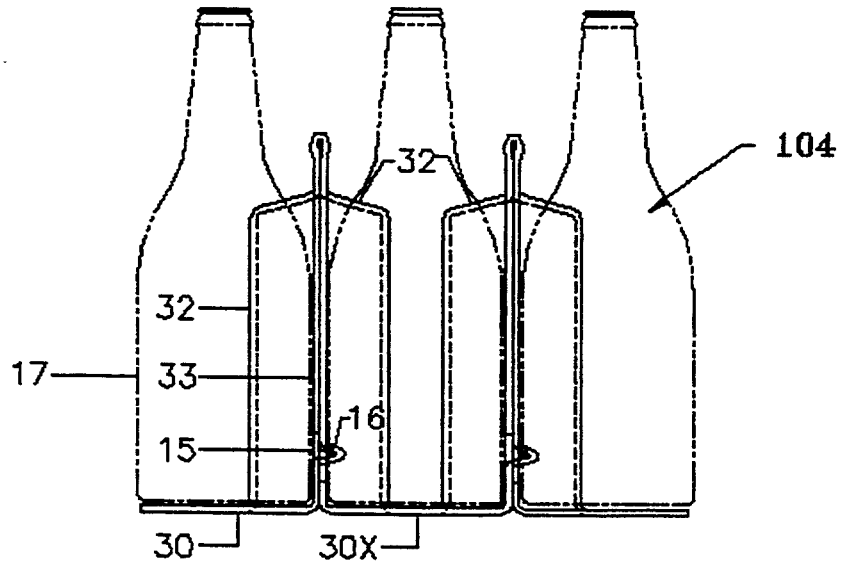
FIG. 7 is an end view of said bottle pack 104 in the completely folded stand up condition with three rows of bottles in place on the bottom panels thereof.
Figure 8:
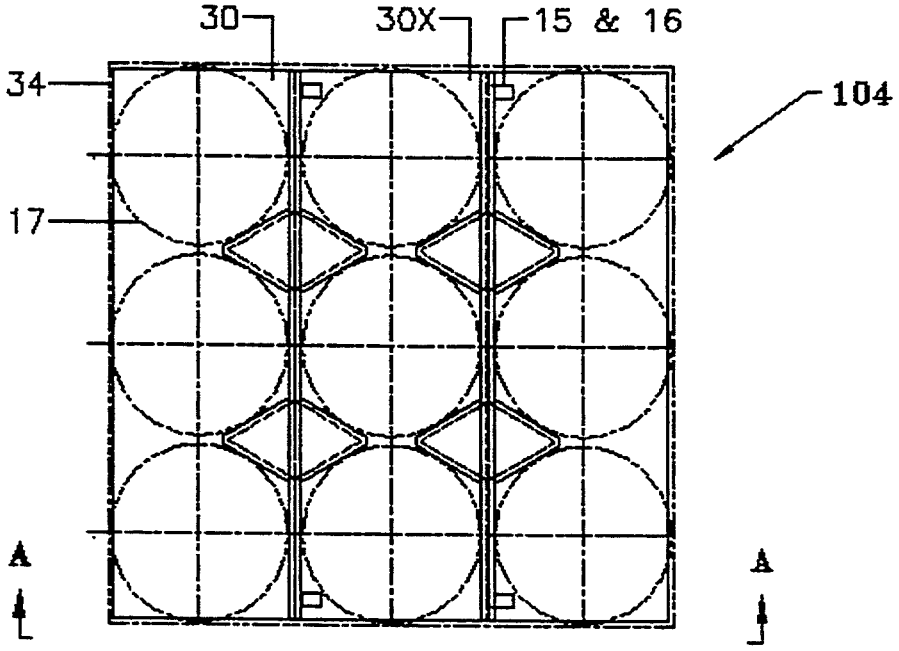
FIG. 8 is a plan view of said bottle pack 104, in a completely folded and alone condition with three rows of three each bottles in place on said bottom panels of said bottle pack 104.

FIG. 7 is an end view of the bottle pack 104 of FIG. 5, showing each pair of said vertical panels 33 forming a barrier between two rows of bottles 17, said bottles resting on said horizontal bottom panels 30 and **30*x*, with the elements 15 and 16 of each locking device projecting from one side of each of said pairs of vertical panels 33, and with said bottom panels 30 and 30*x* in a horizontal position whereby to maintain said vertical panels 33 in an upright position. FIG. 8 is a plan view of the multiple bottle pack 104 of FIG. 7 with the three rows of bottles 17 in place on said bottom panels 30 and 30*x*, with each pair of vertical panels 33 serving as a barrier between two rows of bottles 17, and the bottles in each row spaced apart by said ribs 32, the lock elements 15 and 16 both projecting from one side of each pair of panels 33**.

Figure 9:
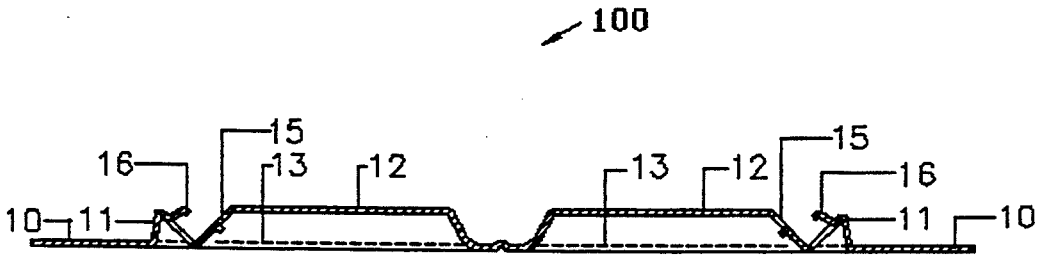
FIG. 9 is a cross-section through line AA of FIG. 10 of folding bottle pack 100 in a completely unfolded condition suitable for placing on the flat tray of a dryer tunnel, and for stacking in the same unfolded condition, said folding bottle pack 100 being suitable for separating two rows of three bottles each in a container.
Figure 10:
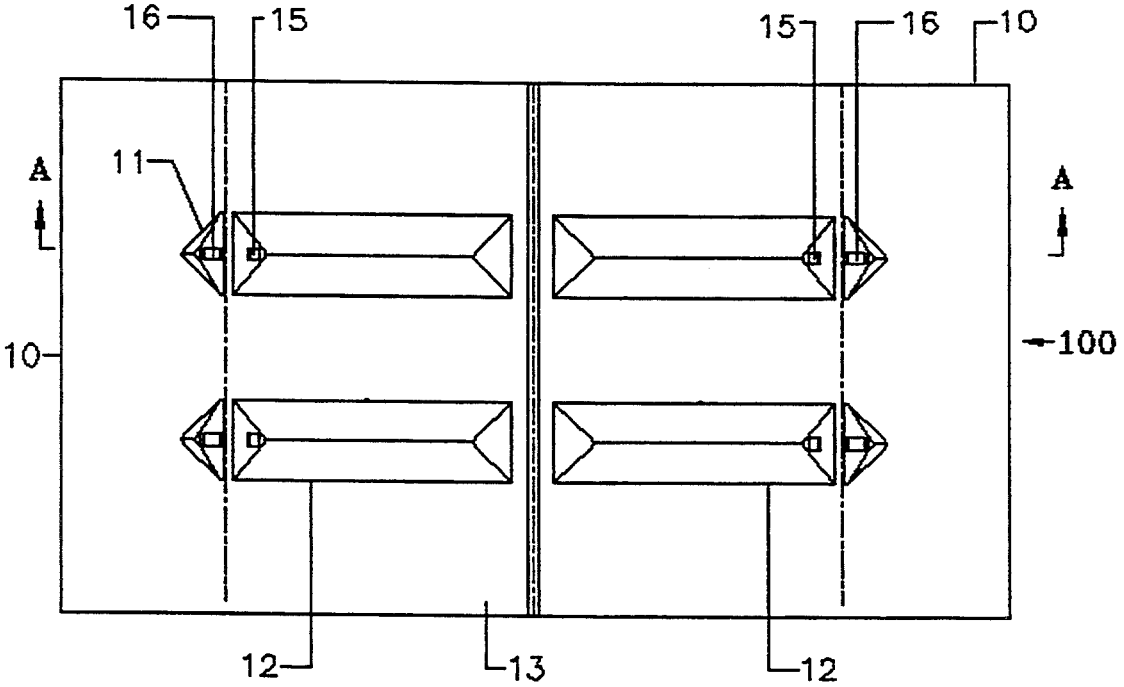
FIG. 10 is a plan view of the completely unfolded bottle pack 100 of FIG. 9.

FIG. 9 is a cross-section, taken at line AA of FIG. 10 of a stand alone bottle pack 100, shown in the fully extended position in which it can be manufactured in a pulp moulding line using a tunnel dryer, to separate from each other the individual bottles 17 in two rows of three bottles each, said bottle pack being comprised of:

two vertical panels 13 hingedly connected to each other at their top edges, each of said vertical panels 13 having two outwardly directed ribs 12 stretching in parallel from the bottom edge of said vertical panel 13 towards the top edge of said panel, each of said ribs 12 having a bottom wall directed outwardly and upwardly from the bottom edge of said vertical panel 13, at an angle of 45° from the vertical face of said vertical panel 13;

two horizontal bottom panels 10, each hingedly connected at an edge to the bottom edge of one of said vertical panels 13, each of said bottom panels 10 having two upwardly directed conical projections 11, each of said conical projections 11 having a wall stretching upwardly and outwardly from said hingedly connected edge at an angle of 45° from the upper surface of said bottom panel 10, and located thereon to make full contact with the facing bottom wall of the immediately adjacent rib 12, each mating pair of the bottom wall of a rib 12 and the facing wall of a conical projection 11 being fitted with the elements 15 and 16 of the locking device of FIG. 18 to lock them together and thus to maintain each vertical panel at an angle of 90° with the bottom panel to which it is hingedly connected.

FIG. 10 is a plan view of the stand alone bottle pack 100 of FIG. 8 in the fully extended position of FIG. 9, showing the two vertical panels connected together in a pair at their top edges, and the two bottom panels 10 each connected to the bottom edge of one of the two vertical panels 13, with the bottom walls of the ribs 12 of said vertical panels 13 each immediately adjacent to a mating wall of one of the conical projections 11, and each mating pair of said walls being provided with the mating elements 15 and 16 of the locking device of FIG. 18.

Figure 11:
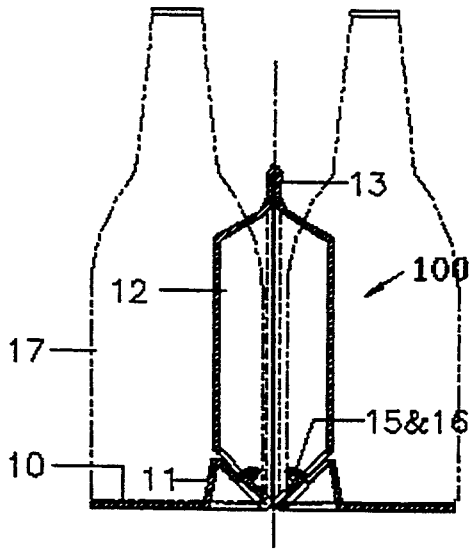
FIG. 11 is an end view of said bottle pack 100 in the completely folded stand up condition with two rows of bottles in place on the bottom panels of said bottle pack 100.

FIG. 11 is an end view of the bottle pack 100 of FIG. 9, showing the bottles 17 in place on the bottom panels 10, the pair of vertical panels 13 serving as a barrier between the two rows of bottles, and the locking elements 15 and 16 locking together the mating walls of said ribs 12 and said conical projections 11 whereby to maintain said vertical panels 13 in the required angle of 90° to said bottom panels.

Figure 12:
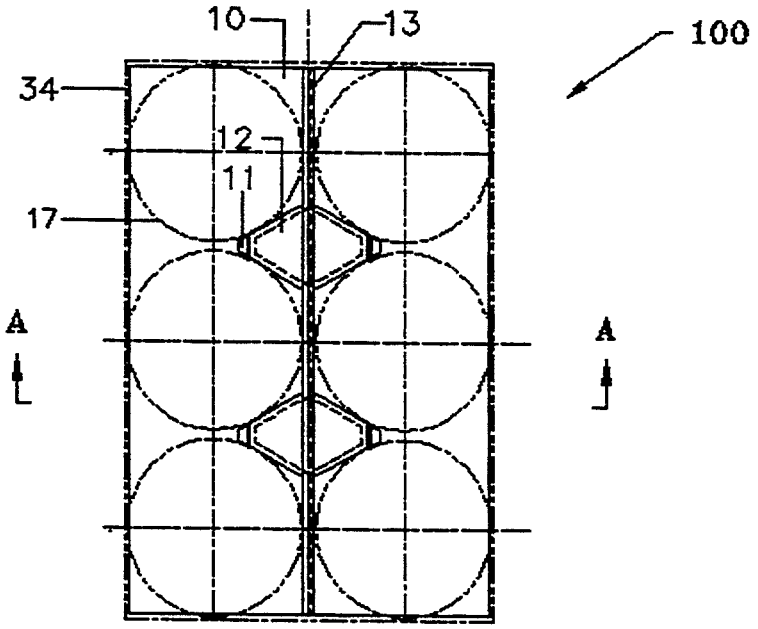
FIG. 12 is a plan view of the bottle pack 100 completely folded in the stand up condition as in a container, and with the two rows of three bottles each in place.

FIG. 12 is a plan view of the bottle pack 100 of FIG. 11, showing said bottles 17 in place on said bottom panels 10, with the two rows of bottles 17 separated by the pair of said vertical panels 13, and spaced apart in the rows by the ribs 12 and the conical projections 11, the overall perimeter of the pair of said bottom panels being of appropriate dimensions to fit closely within the interior of the side walls 34 of the container, and thus to maintain said vertical panels in the intended upright position.

Figure 13:
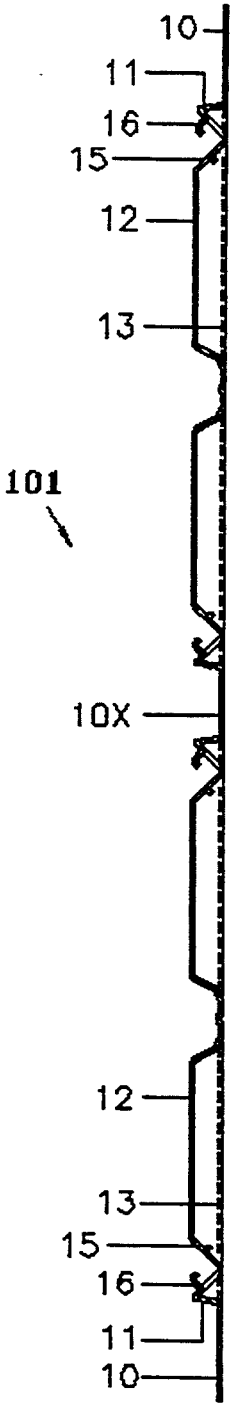
FIG. 13 is a cross-section at line AA of FIG. 14 through a multiple folding bottle pack 101 for separating from each other the bottles in three rows of bottles with at least two bottles in each row, shown in the completely unfolded condition in which it can be placed on the flat tray of a tunnel dryer.
Figure 14:
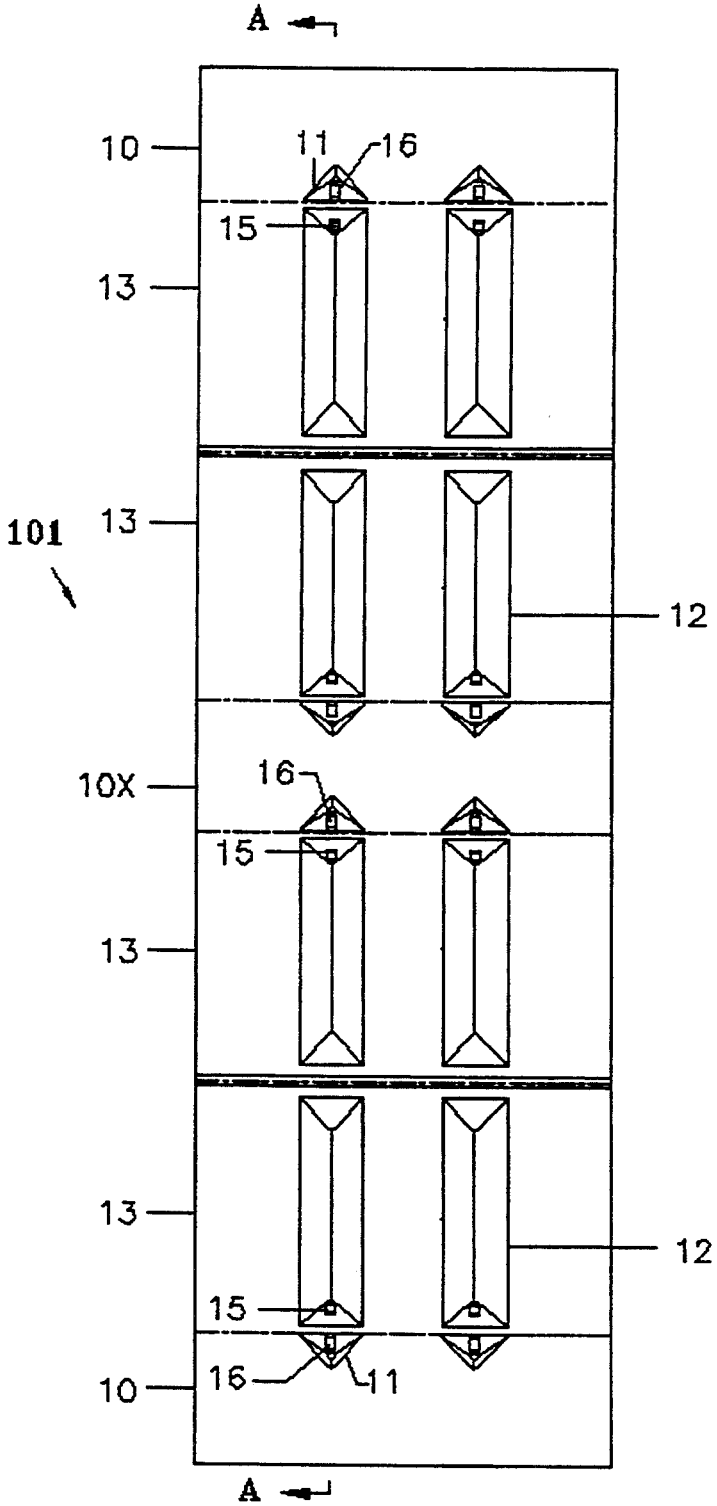
FIG. 14 is a plan view of the bottle pack 101 in the completely unfolded condition of FIG. 13.

FIG. 13 is a cross-section at line AA of FIG. 14, showing a multiple stand alone folding bottle pack 101 in the fully extended condition in which it can be manufactured, to separate from each other the individual bottles 17 in three rows of said bottles with three bottles in each row, said bottle pack being composed of:

four vertical panels 13 hingedly connected to each other in pairs at their top edges, each of said panels 13 having two outwardly directed ribs 12 stretching vertically and in parallel from the bottom edge towards to the top edge of said vertical panel 13, each of said ribs 12 having a bottom panel stretching outwardly and upwardly from the bottom edge of said vertical panel 13 at an angle of 45° with the surface of said vertical panel 13;

two horizontal bottom panels 10, the first of said panels 10 being hingedly connected at one edge with the bottom edge of the vertical panel 13 facing the first row of bottles in the pack, and the second of said bottom panels 10 being hingedly connected with the vertical panel 13 facing the third row of bottles in the pack, each of said bottom panels 10 having two upwardly directed conical projections 11, each of said conical projections having a wall stretching upwardly and outwardly from said hingedly connected edge to form an angle of 45° with the surface of said bottom panel 10;

one bottom panel 10x hingedly connected at each of two parallel edges to the bottom edge of one of said vertical panels 13 facing the second, or intermediate, row of bottles in the pack, said bottom panel 10x having four upwardly directed conical projections, a first two of said conical projections stretching from one of said hingedly connected edges, and the second two of said conical projections 11 stretching from a second parallel edge of said bottom panel 10x, each of said four conical projections 11 having an outwardly and upwardly directed wall stretching from one of said hingedly connected edges of said bottom panel to form an angle of 45° with the surface of said bottom panel 10x;

each mating pair of the bottom wall of a rib 12 and the facing wall of a conical projection 11 being fitted with the elements 15 and 16 of the locking device of FIG. 18, to lock them together and thus to maintain each vertical panel 13 at an angle of 90° with the bottom panel to which it is hingedly connected.

FIG. 14 is a plan view of the stand alone folding bottle pack 101 of FIG. 13 showing the continuously hingedly connected series of bottom panels 10 and 10x and the vertical panels 13 in pairs, with the mating walls of the ribs 12 and the conical projections, and the locking elements 15 and 16 located thereon.

Figure 15:
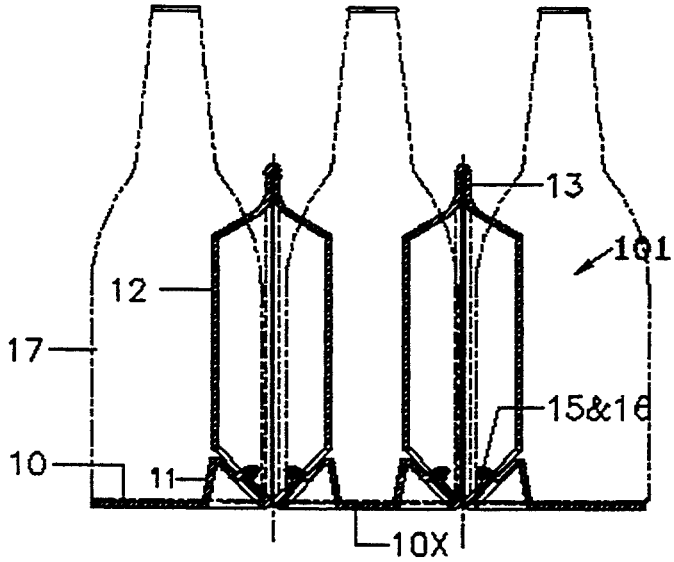
FIG. 15 is an end view of said bottle pack 101 shown in the completely folded stand up position with three rows of bottles in place on said bottom panels of said bottle pack.

FIG. 15 is an end view of the bottle pack 101 of FIG. 13, showing the three rows of bottles 17 standing on the bottom panels 10 and 10x and the locking elements 15 and 16 locking together the mating walls of the ribs 12 on the vertical panels 13, and the conical projections 11 on the bottom panels 10 and 10x.

FIG. 16 is a plan view of said bottle pack 101 with the three rows of bottles in place on the bottom panels 10 and 10x, said four vertical panels 13 in two pairs serving to separate the three rows of bottles 17 from each other, and said ribs 12 serving to separate from each other the individual bottles 17 in each row, the overall perimeter of the three bottom panels having appropriate dimensions to fit closely with the side walls 34 of the container and thus to maintain said pairs of vertical panels 13 to remain in contact or close proximity with each other and thus to maintain their vertical position as determined by the locked together ribs 12 and conical projections 11.

I claim:

1. A stand alone folding bottle pack for use in a container having a bottom wall and four side walls, said bottle pack serving to separate and protect from contact with each other the individual bottles in at least two rows of bottles with at least two bottles in each row, said bottle pack being comprised of:

at least two vertical panels hingedly connected in pairs at their top edges to stand upright in said container, each of said vertical panels having at least one outwardly directed vertical rib;

at least two horizontal panels to rest flat on said bottom wall of said container, each of said bottom panels being connected at at least one of its edges to at least one of said vertical panels;

whereby to form a continuously connected series of at least two of said horizontal bottom panels and at least one pair of said vertical panels.

2. The bottle pack of claim 1 to separate from each other the individual bottles of two rows of bottles with at least two bottles in each row, said bottle pack being comprised of:

a first vertical panel having a top edge and a bottom edge, an inwardly directed face and an outwardly directed face, said outwardly directed face having one outwardly directed first rib where there are only two bottles in each row, and having an additional one of said ribs for each additional bottle in each row, said first rib and said additional rib or ribs stretching vertically between said bottom edge and said top edge, each of said ribs having a bottom edge;

a second vertical panel similar to said first vertical panel and hingedly connected thereto at their respective top edges, said second vertical panel having a rib or ribs similar to the rib or ribs of said first vertical panel;

a first horizontal panel having an edge and an upwardly directed surface, said edge being integrally and rigidly connected to the bottom edge of said first vertical panel and to the bottom edge or edges of the rib or ribs thereof, with the upwardly directed surface of said first horizontal panel normal to the outwardly directed surface of said first vertical panel;

a second horizontal panel having an edge and an upwardly directed surface, said edge of said second horizontal panel being integrally and rigidly connected to the bottom edge of said second vertical panel and to the bottom edge or edges of said rib or ribs thereof, with the upwardly directed surface of said second horizontal panel normal to the outwardly directed surface of said second vertical panel;

whereby to form a continuously connected series of panels comprised of two horizontal bottom panels and one pair of vertical panels.

3. The bottle pack of claim 2, with at least two locking devices arranged to maintain the inwardly directed surface of said first vertical panel in position facing and in close proximity or in contact with the inwardly directed surface of said second vertical panel hingedly connected thereto.

4. The bottle pack of claim 1 to separate from each other the individual bottles in at least three rows of bottles with at least two bottles in each row, said bottle pack being comprised of:

at least two pairs of vertical panels, each of said pairs having two vertical panels hingedly connected at their respective top edges, each of said vertical panels having one outwardly directed rib where there are only two bottles in each row, and an additional one of said ribs for each additional bottle in each row, said first rib and said additional rib or ribs stretching vertically between the bottom edge and the top edge of the related vertical panel, each of said ribs having a bottom edge;

two outwardly directed horizontal bottom panels comprised of a first outwardly directed bottom panel supporting the first row of bottles and a final outwardly directed bottom panel supporting the final row of bottles, each of said bottom panels having an edge and an upwardly directed surface, said edge of said first outwardly directed bottom panel being integrally and rigidly connected to the bottom edge of the one of said vertical panels facing the first row of bottles in the pack and to the bottom edge or edges of the rib or ribs related thereto, and the edge of said final outwardly directed bottom panel being integrally and rigidly connected to the bottom edge of the one of said vertical panels facing the final row of bottles in the pack, and to the bottom edge or edges of the rib or ribs related thereto;

at least two intermediate horizontal bottom panels, each having a first edge and a second edge and an upwardly directed surface, said bottom panels being hingedly connected in pairs at their respective first edges and each of said intermediate bottom panels being integrally and rigidly connected at their respective second edges to the bottom edge of one of said intermediate vertical panels, and to the bottom edge or edges of the related ribs of said vertical panels;

whereby to form a continuously connected series of two outwardly directed bottom panels, one at each end of said series, and at least four vertical panels in pairs, alternating with at least two intermediate bottom panels in pairs;

whereby each of said pairs of vertical panels may serve as a barrier between two rows of bottles, each of said outwardly directed bottom panels may serve to support a first row or a last row of bottles in the pack and serve also to space the adjacent vertical panel a predetermined distance from said side wall of said container to receive one row of bottles therebetween, and said intermediate pairs of bottom panels may serve to space apart their respective immediately adjacent pairs of said pairs of vertical panels a predetermined distance to receive one additional row of bottles in each of said spaces.

5. The stand alone folding bottle pack of claim 4, with at least two locking devices provided in each hingedly connected pair of vertical panels to maintain the inwardly directed surfaces of each of said panels facing each other and in close proximity to each other or in contact with each other.

6. The stand alone folding bottle pack of claim 1 to separate from each other the individual bottles in two rows of bottles with at least two bottles in each row, said bottle pack being comprised of:

a first vertical panel having a top edge and a bottom edge, an inwardly directed surface and an outwardly directed surface, said outwardly directed surface having one outwardly directed rib where there are only two bottles in each row, and an additional one of said ribs for each additional one of said bottles in each row, said rib or ribs stretching vertically between said bottom edge and said top edge, each of said ribs having a bottom wall stretching upwardly and outwardly from said bottom edge at 45° from said outwardly directed surface of said first vertical panel;

second vertical panel similar to said first vertical panel and hingedly connected thereto at their respective top edges, said second vertical panel having at least one outwardly directed rib similar in number, location and bottom wall or walls to said rib or ribs in said first vertical panel;

a first horizontal bottom panel having an edge and an upwardly directed surface, said first bottom panel being hingedly connected at said edge to said bottom edge of said first vertical panel, said first bottom panel having at least one conical projection directed upwardly from said upwardly directed surface, each of said at least one conical projections having one surface stretching upwardly and outwardly from said hingedly connected edge at 45° to said upwardly directed surface, each of said conical projections being located immediately adjacent to one of said ribs;

whereby said bottom face of each one of said ribs can make full contact with said immediately adjacent face of one of said conical projections when the related bottom panel is folded along its hinged connection with the immediately adjacent vertical panel, with the upwardly directed surface of said bottom panel normal to the outwardly directed surface of said vertical panel.

7. The stand alone folding bottle pack of claim 6 with at least two locking devices to maintain said inwardly directed surface of said first vertical panel facing and in close proximity or in contact with said inwardly directed surface of said second panel, and with one locking device to maintain contact between each one of said bottom walls of said ribs with the immediately adjacent wall of one of said upwardly directed projections, thereby to maintain the related bottom panel in position normal to the vertical panel to which it is hingedly connected.

8. The stand alone folding bottle pack of claim 1 to separate from each other the individual bottles in at least three rows of bottles with at least two bottles in each row, said bottle pack being comprised of:

at least two pairs of vertical panels, each of said pairs having two vertical panels hingedly connected at their respective top edges, each of said vertical panels having one outwardly directed rib where there are only two bottles in each row, and one additional rib for each additional bottle in each row, each of said ribs stretching vertically between the bottom edge and said top edge of the related vertical panel, each of said ribs having a bottom wall stretching upwardly and outwardly at 45° from the surface of said vertical panel;

two outwardly directed horizontal bottom panels comprised of a first outwardly directed bottom panel supporting the first row of bottles in the pack, and a final outwardly directed bottom panel supporting the final row of bottles, each of said bottom panels having an upwardly directed surface and an edge, said first bottom panel being hingedly connected at said edge to said bottom edge of the vertical panel facing said first row of bottles, and having at least one conical projection upwardly directed from said upwardly directed surface, each of said at least one conical projections having one surface stretching upwardly and outwardly from said hingedly connected edge at 45° to said upwardly directed surface, each of said conical projections being located immediately adjacent to one of said ribs;

at least one intermediate horizontal bottom panel, each of said intermediate bottom panel or panels having two parallel edges and an upwardly directed surface, each of said intermediate bottom panel or panels being hingedly connected to two of said vertical panels at their respective bottom edges, one of said panels being hingedly connected at each of said two parallel edges, each of said intermediate bottom panels having at each of said parallel edges at least one upwardly directed conical projection with one wall stretching upwardly and outwardly from said hingedly connected edge at 45° to said upwardly directed surface, each of said conical projections being located immediately adjacent to one of said ribs;

whereby said bottom wall of each of said ribs on each one of said vertical panels can make full contact with the immediately adjacent face of one of said conical projections when the related bottom panel is folded along its hinged connection with the immediately adjacent vertical panel, with said upwardly directed surface of said bottom panel normal to the outwardly directed surface of said vertical panel.

* * * * *